United States Patent [19]

Withers, Jr.

[11] 4,102,393

[45] Jul. 25, 1978

[54] HEAT EXCHANGE APPARATUS

[75] Inventor: James G. Withers, Jr., Dearborn, Mich.

[73] Assignee: UOP Inc., Des Plaines, Ill.

[21] Appl. No.: 724,036

[22] Filed: Sep. 17, 1976

Related U.S. Application Data

[62] Division of Ser. No. 617,453, Sep. 23, 1975, Pat. No. 4,007,774.

[51] Int. Cl.[2] ..... F28F 19/00

[52] U.S. Cl. ..... 165/95; 165/97; 165/174

[58] Field of Search ..... 165/95, 97, 174; 137/239

[56] References Cited

U.S. PATENT DOCUMENTS

| | | | |
|---|---|---|---|
| 1,297,292 | 3/1919 | Cammen | 165/174 |
| 1,464,269 | 8/1923 | Krakan | 165/174 |
| 1,611,475 | 12/1926 | Maxim | 165/174 |
| 2,040,704 | 5/1936 | Modine | 165/174 |
| 2,487,484 | 11/1949 | Simpelaar | 165/97 |
| 2,490,759 | 12/1949 | Tyden | 165/97 |
| 2,731,242 | 1/1956 | Borg | 165/174 |
| 2,864,588 | 12/1958 | Booth | 165/174 |
| 3,627,014 | 12/1971 | Akashi | 165/97 |
| 3,770,050 | 11/1973 | Nakanishi | 165/97 |
| 3,971,667 | 7/1976 | Blaude | 165/97 |

*Primary Examiner*—Charles J. Myhre
*Assistant Examiner*—Daniel J. O'Connor
*Attorney, Agent, or Firm*—James R. Hoatson, Jr.; Barry L. Clark; William H. Page, II

[57] ABSTRACT

An improvement in heat transfer and a reduction in fouling by liquid flowing inside of heat exchanger tubes is achieved by the apparatus and method of the present invention wherein the heat exchanger includes internally ridged or corrugated metal tubes rather than conventional plain tubes. Despite the formation of a normal appearing fouling layer on the downstream portion of a ridge, the ridged tubes remain relatively clear on the upstream portion of the ridge. Periodically, as the downstream portions of the tubing ridge surfaces build up a fouling coating, the flow direction of the tube side fluid is reversed to remove at least a substantial portion of the previously deposited coating.

4 Claims, 3 Drawing Figures

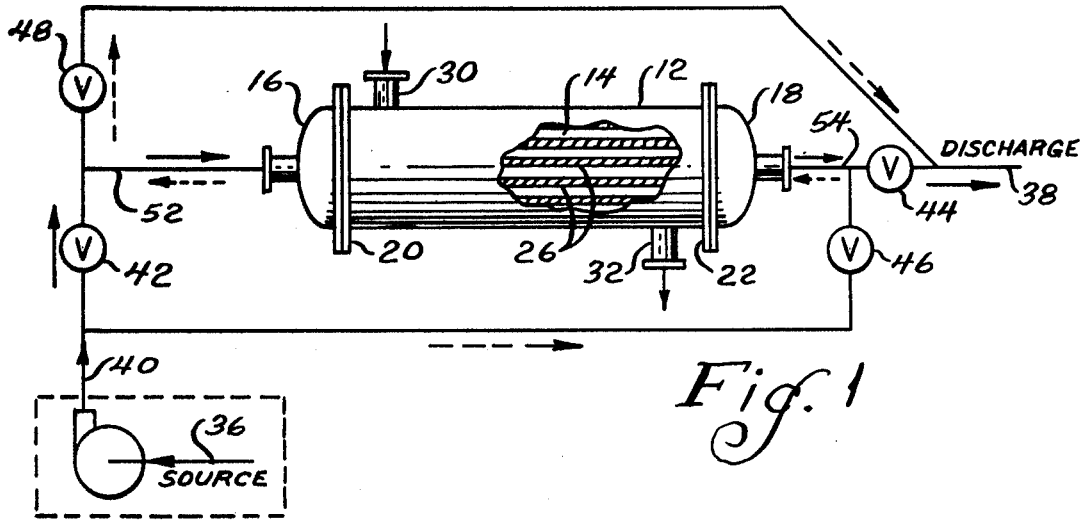
Fig. 1
Fig. 2
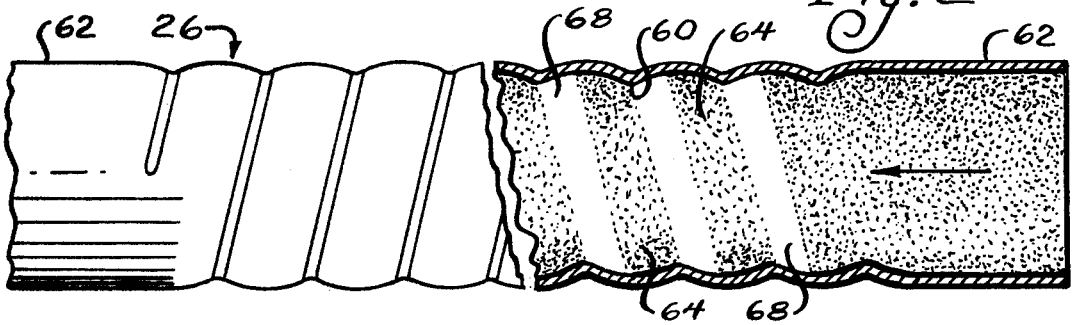
Fig. 3
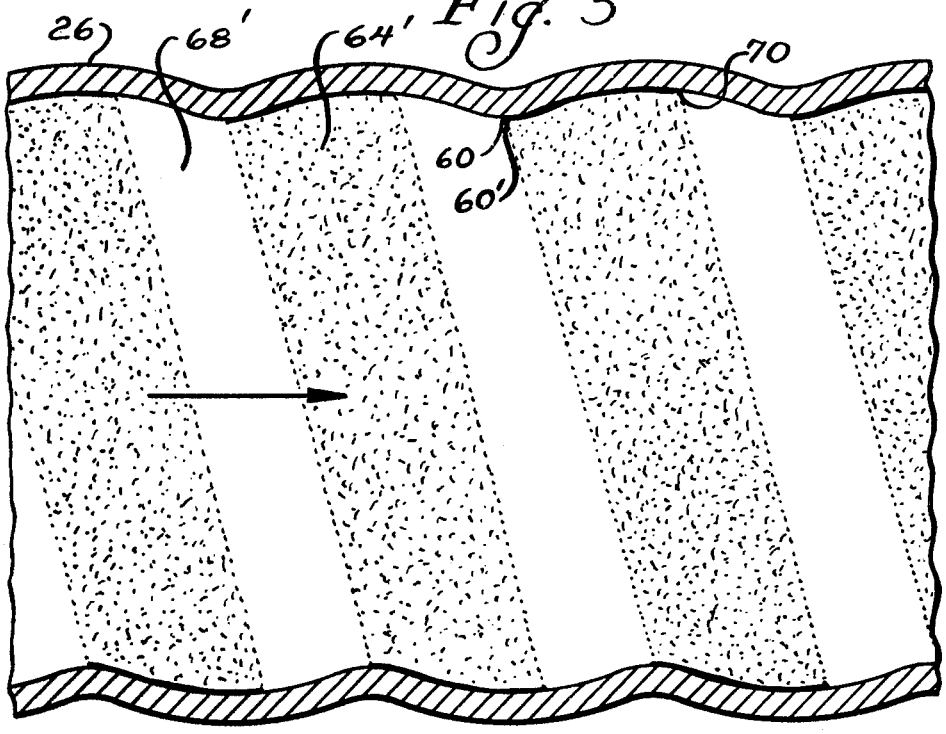

HEAT EXCHANGE APPARATUS

This is a division of application Serial No. 617,453, filed Sept. 23, 1975, now U.S. Pat. 4,007,774.

BACKGROUND OF THE INVENTION

This invention relates to the improvement of heat transfer in heat exchangers and in particular to heat exchangers in which process fluids are circulating which have a tendency to coat or "foul" the inside tube surface. Such fouling coatings produce a thermal resistance which inhibits heat transfer and lowers the heat transfer coefficient of the tubing.

When fouling conditions during operation are anticipated, it is common practice to build heat transfer units much larger than if no fouling was expected. For example, the amount of tubing required for a given job could be selected during the design stage in accordance with the decreased heat transfer efficiency to be expected after a pre-determined amount of fouling had taken place. A system can also be designed so that different sections can be sequentially taken out of service to permit cleaning to take place in one section while other sections remain in operation. Either of these measures takes an economic toll.

It is common to clean fouled surfaces by circulating a solvent or other type of cleaning fluid through tubing as exemplified in Tyden U.S. Pat. No. 2,490,759 and Matthiesen U.S. Pat. No. 3,647,687. Obviously, such a cleaning process removes the heat transfer unit from operation and would thus interupt the process operation in which the unit was used. U.S. Pat. No. 3,211,217 to McKee et al shows a multipass heat transfer unit designed to be used with cooling fluid such as river water which commonly contains a large amount of debris which tends to collect in the inlet ends of the plain tubes so as to obstruct them. A valve in the unit reverses the flow of fluid through the tubes and dislodges the debris which then passes through the drain. Since the tubes are disclosed as being plain, the reversal of flow direction could not be expected to be effective in abating relatively uniform fouling coatings such as microcrystalline scale or sludge. Wolfe, Jr. U.S. Pat. No. 3,450,193 teaches that corrugated tubing should be used in only a single flow direction and that the inlet end should be of larger diameter than the outlet.

SUMMARY OF THE INVENTION

It is among the objects of the present invention to provide an improved apparatus and method for increasing the efficiency of heat transfer in a heat transfer unit used with a liquid having a tendency to foul while at the same time decreasing the amount of tubing required for a given job. These and other objects are accomplished by the present invention wherein tubing having an internal ridge shape which resists deposits of a fouling layer on the upstream side of the ridging is utilized in combination with valve means which can be periodically actuated to reverse the direction of fluid flow. Since the rate of fouling deposition is sensitive to local turbulence levels, the flow reversal tends to remove at least a substantial portion of the fouling layer which had formed during the prior flow cycle on the downstream portion of the ridging. The plain end portions of the tubes which are usually provided for mounting the tubes in tube sheets will usually comprise an insignificant fraction of the tube length, albeit the inlet end will normally experience relatively turbulent flow due to the entry effect. However, in the ridged portion of the tube, the hydrodynamic pattern will change as each ridge convolution is encountered. The presence of a ridge is believed to produce a boundary layer separation which yields very active turbulence in the vicinity of the point where the boundary layer reattaches to the tube wall. In the less active zone under the separated boundary layer a fouling coating can form at about the same rate as in a plain tube while the relative turbulence in the region between the boundary layer reattachment point and the crest of the next ridge convolution will tend to keep the tube wall clean of any fouling layer. To be effective, the ridging has to be generally transverse to the tube axis, and preferably, the lead angle of the ridging, which can be single start or multiple start, should be less than 60°, as measured from a perpendicular to the tube axis.

The axial extent of the fouling, expressed as a fraction of the ridge pitch, which can take place in different types of internally ridged tube can be expected to vary. However, tubing of the type disclosed in Withers et al U.S. Pat. No. 3,779,312, and sold by Wolverine Division of UOP Inc. under the trademark "Korodense ®", has been shown to exhibit a relatively clean interior surface upstream of the ridge crest and a fouled surface downstream after being subjected to fouling conditions. The clean and fouled areas were quite distinct with the fouled area slightly larger than the clear area. Internally ridged tubing of the type disclosed in Withers et al U.S. Pat. No. 3,847,212, sold under the trademark "Turbo-Chil", has been shown in tests as having a fouling factor just 43% of that for plain tube when tested in unidirectional flow and could be expected to lose at least a substantial portion of a previously deposited fouling coating shortly after each change of flow direction.

In summary, the substitution of internally ridged tube for plain tube in a heat exchanger can be shown to provide an increase in overall heat transfer efficiency, not only for the expected reason that increased turbulence is provided by the ridges but because the ridges result in a lower fouling factor for the tube. By reversing the direction of flow periodically, heat transfer efficiency is enhanced since previously deposited fouling coatings are removed, at least to a substantial degree.

BRIEF DESCRIPTION OF THE DRAWINGS

FIG. 1 is a schematic view of a heat exchange apparatus in accordance with the present invention;

FIG. 2 is an enlarged, partially sectioned side view of one of the tubes in the apparatus shown in FIG. 1; and FIG. 3 is an enlarged view of a portion of the tube shown in FIG. 2 where the fluid flow direction is reversed.

DESCRIPTION OF THE PREFERRED EMBODIMENT

FIG. 1 shows a schematic view of a shell and tube heat exchanger indicated generally at 10 which has been made in accordance with the present invention. The shell 12 of the heat exchanger includes a central chamber portion 14 and end chamber portions 16,18. Flange portions 20,22 at each end of central chamber portion 14 support tube sheets (not shown) which mount a plurality of tubes 26. The flange portions also provide a means for attaching and sealing the end chamber portions 16,18 to the central portion. A shell side fluid to be cooled or heated typically enters the chamber 14 through inlet fitting 30 and exits through outlet fitting 32 after being cooled or heated by contact with the outer surface of the internal array of tubes 26. The tubes 26 have a second fluid to be heated or cooled passing through them from a source 36 to a discharge 38. In order to permit fluid in line 40 to pass in either direction through the heat exchanger tubes 26, a plurality of valves 42,44,46 and 48 are provided. For left to right flow, as indicated by the solid arrows on fluid lines 52,54, valves 42 and 44 are opened and valves 46,48 are closed. For right to left flow, as indicated by the dotted arrows, valves 42 and 44 are closed and valves 46,48 are opened.

FIG. 2 is an enlarged view of one of the tubes 26 which incorporates the alternate convex-concave shape disclosed in U.S. Pat. No. 3,779.312. The tube is shown as having a single start internal ridge 60 and smooth end portions 62. The tube is also shown as having a fouling coating 64 in the smooth end portion 62 as well as downstream of the ridging 60 when flow is in the right to left direction indicated by the arrow. The areas 68 which are upstream of the ridging 60 are relatively clean.

FIG. 3 is an enlarged view of a section of tubing 26 and shows the fouling layer 64' and clean areas 68' which develop when the fluid flow is from the left. The fouling layer 64' forms in the relatively stagnant flow area between the ridge apex 60' and a line or region 70 downstream of the ridge. By comparing the fouling coatings 64,64' in FIGS. 2 and 3, one can see that reversing the flow direction will reverse the conditions for mass transfer and remove a substantial part of the previously deposited fouling coating in the ridged portion of the tube. The fouling coatings in the smooth end portions 62 could conceivably be affected by the flow reversal. However, coatings in the tube ends are not very significant since the tube ends make up a small percentage of the tube lengths.

I claim as my invention:

1. An improved heat exchange apparatus for use with a tubeside fluid which is capable of fouling the tube walls comprising at least one tube for circulating fluid through the apparatus, said at least one tube being characterized in that it has integral internal ridging in its inner wall which is generally transverse to the tube axis and has a lead angle of less than 60° as measured from a perpendicular to the tube axis, said ridging being adapted to turbulate said tubeside fluid to prevent fouling of the areas of the tube immediately upstream of the ridging, and valve means for reversing the direction of fluid flow of said tubeside fluid within said at least one tube.

2. The apparatus of claim 1 wherein the inner wall of said at least one tube has an alternately concave and convex profile in a longitudinal section taken along the major portion of its length.

3. The apparatus of claim 1 wherein said internal ridging comprises a single start helix.

4. The apparatus of claim 1 wherein said internal ridging comprises a multiple start helix.

* * * * *